US009088839B2

(12) United States Patent
Kohn et al.

(10) Patent No.: US 9,088,839 B2
(45) Date of Patent: Jul. 21, 2015

(54) MULTIMEDIA AUDITORY AUGMENTATION

(71) Applicants: Jonah L. Kohn, San Diego, CA (US); Yariv Kohn, San Diego, CA (US)

(72) Inventors: Jonah L. Kohn, San Diego, CA (US); Yariv Kohn, San Diego, CA (US)

(73) Assignees: Jonah Kohn, San Diego, CA (US); Yariv Kohn, San Diego, CA (US)

( * ) Notice: Subject to any disclaimer, the term of this patent is extended or adjusted under 35 U.S.C. 154(b) by 0 days.

(21) Appl. No.: 13/710,219

(22) Filed: Dec. 10, 2012

(65) Prior Publication Data

US 2014/0161286 A1 Jun. 12, 2014

(51) Int. Cl.

| | |
|---|---|
| ***H04R 25/00*** | (2006.01) |
| ***H04R 3/00*** | (2006.01) |
| ***H04R 23/00*** | (2006.01) |

(52) U.S. Cl.
CPC . *H04R 3/00* (2013.01); *H04R 23/00* (2013.01)

(58) Field of Classification Search
CPC ... H04R 2460/13; H04R 25/00; H04R 1/1016
USPC ..... 381/151, 312, 326, 380
See application file for complete search history.

(56) References Cited

U.S. PATENT DOCUMENTS

| | | | | |
|---|---|---|---|---|
| 5,521,982 | A * | 5/1996 | Schiftan | 381/151 |
| 6,694,035 | B1 * | 2/2004 | Teicher et al. | 381/326 |
| 8,699,742 | B2 * | 4/2014 | Heiman et al. | 381/380 |

OTHER PUBLICATIONS

Nanayakkara, et al, "Enhancing Musical Experience for the Hearing-impaired using Visual and Haptic Displays," http://fluid.media.mit.edu/sites/default/files/Enhancing%20musical%20experience%20for%20the%20deaf_Nanayakkara%20et%20al_Final_v5.pdf, on or around Jul. 19, 2012, 42 Pages.

Wyse, et al, "Perception of vibrotactile stimuli above 1kHz by the hearing-impaired," NIME '12, May 21/23, 2012, http://fluid.media.mit.edu/sites/default/files/VibrotactileSensitivityNIME_v4.pdf, 6 Pages.

Myles, et al, "Exploring the Tactile Modality for HMDs1," This chapter is an extended version of the ARL Technical Report: Myles, K. and Binseel, M.S. (2007). The Tactile Modality: A Review of Tactile Sensitivity and Human Tactile Interfaces; ARL-TR-4115. Army Research Laboratory: Aberdeen Proving Ground, MD, Chapter 18, pp. 849-876.

SoundFest Website, "RealClarity App," on or around Sep. 11, 2012, 3 Pages.

Beck, "Testing, Testing . . . Can You Hear Better Now?," The Wall Street Journal Website, http://www.wsj.com/articles/SB10000872396390443921504577643451266751104, Sep. 10, 2012, 5 Pages.

YouTube Video, "Good Vibrations—Google Science Fair Application," https://www.youtube.com/watch?v=S7nPpnkPDb4&feature=youtu.be, on or around Jul. 27, 2012.

Ono, "The effect of musical experience on hemispheric lateralization in musical feature processing," Neurosci Lett. Jun 1, 2011;496(2):141-5. doi: 10.1016/j.neulet.2011.04.002. Epub Apr. 12, 2011, 2 Pages.

* cited by examiner

*Primary Examiner* — Suhan Ni
(74) *Attorney, Agent, or Firm* — Berkeley Law & Technology Group, LLP

(57) ABSTRACT

Briefly, as an example, embodiments of methods, apparatuses, systems or the like are disclosed to be used for multimedia auditory augmentation.

32 Claims, 4 Drawing Sheets

MULTIMEDIA AUDITORY AUGMENTATION

BACKGROUND

1. Field

This disclosure relates to augmenting perception of auditory stimuli, such as for the hearing impaired.

2. Information

If an individual is affected by a loss of hearing, the individual may employ a hearing aid or other amplifying device worn behind the ear or around the neck so that he or she may at least be able to converse with others. However, although a hearing aid may assist an individual in carrying on a conversation or listening to a lecture, for example; typically hearing aids enhance or amplify sound within a narrow band of frequencies. Cochlear implants have similar limitations. Therefore, a wide range of potential sounds may be unaddressed.

BRIEF DESCRIPTION OF DRAWINGS

Claimed subject matter is particularly pointed out and/or distinctly claimed in the concluding portion of the specification. However, both as to organization and/or method of operation, together with objects, features, and/or advantages thereof, claimed subject matter may be understood by reference to the following detailed description if read with the accompanying drawings in which:

Figure 1:
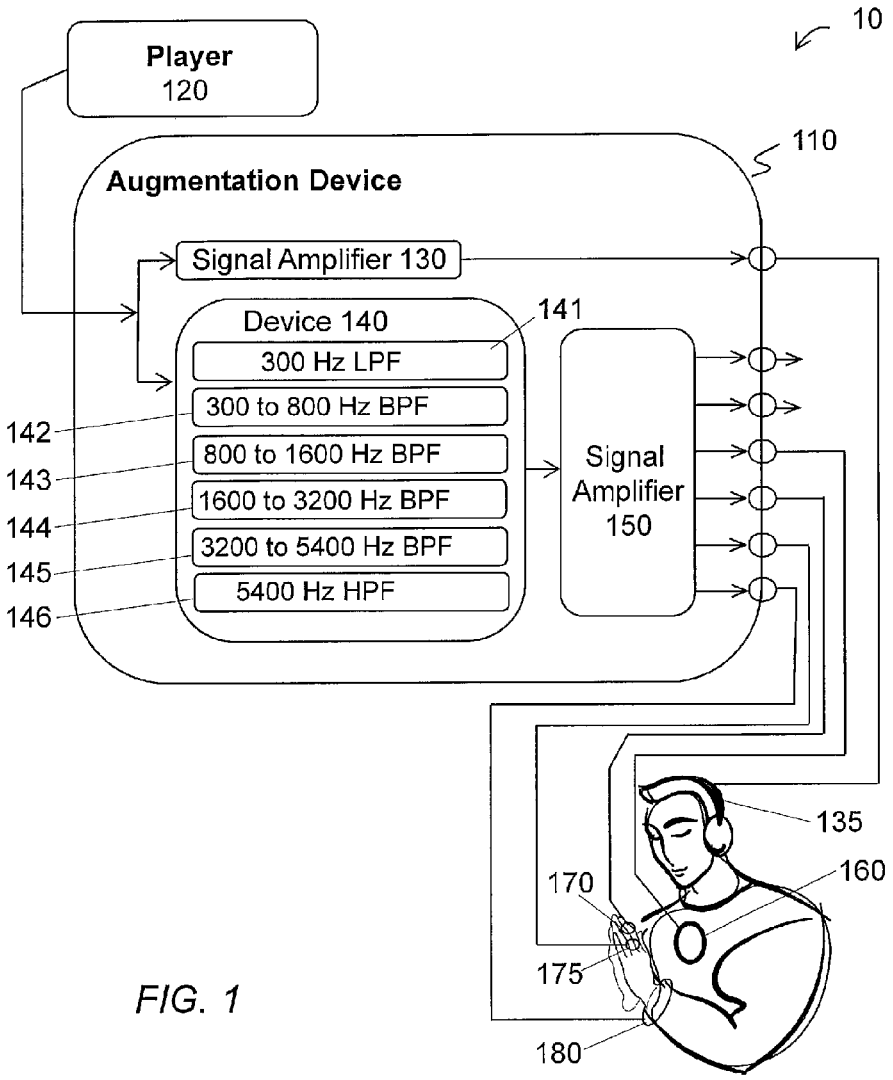
FIG. 1 is a schematic diagram of an embodiment of a system for multimedia auditory augmentation.

Reference is made in the following detailed description to accompanying drawings, which form a part hereof, wherein like numerals may designate like parts throughout to indicate corresponding and/or analogous components. It will be appreciated that components illustrated in the figures have not necessarily been drawn to scale, such as for simplicity and/or clarity of illustration. For example, dimensions of some components may be exaggerated relative to other components. It is to be understood that other embodiments may be utilized. Furthermore, structural and/or other changes may be made without departing from claimed subject matter. It should also be noted that directions and/or references, for example, up, down, top, bottom, left, right, and so on, may be used to facilitate discussion of drawings and/or are not intended to restrict application of claimed subject matter. Therefore, the following detailed description is not to be taken to limit claimed subject matter and/or equivalents.

DETAILED DESCRIPTION

In the following detailed description, numerous specific details are set forth to provide a thorough understanding of claimed subject matter. For purposes of explanation, specific numbers, systems and/or configurations are set forth, for example. However, it should be apparent to one skilled in the relevant art having benefit of this disclosure that claimed subject matter may be practiced without specific details. In other instances, well-known features may be omitted and/or simplified so as not to obscure claimed subject matter. While certain features have been illustrated and/or described herein, many modifications, substitutions, changes and/or equivalents may occur to those skilled in the art. It is, therefore, to be understood that appended claims are intended to cover any and all modifications and/or changes as fall within claimed subject matter.

Reference throughout this specification to one implementation, an implementation, one embodiment, an embodiment, or the like may mean that a particular feature, structure, or characteristic described in connection with a particular implementation or embodiment may be included in at least one implementation or embodiment of claimed subject matter. Thus, appearances of such phrases, for example, in various places throughout this specification are not necessarily intended to refer to the same implementation or to any one particular implementation described. Furthermore, it is to be understood that particular features, structures, or characteristics described may be combined in various ways in one or more implementations. In general, of course, these and other issues may vary with context. Therefore, particular context of description or usage may provide helpful guidance regarding inferences to be drawn.

It should be understood that for ease of description a hardware device, such as a network device, for example, may be embodied and/or described in terms of a computing device. However, it should further be understood that this description should in no way be construed that claimed subject matter is limited to one embodiment, such as a computing device or a network device, and, instead, may be embodied as a variety of devices, including, for example, one or more illustrative examples.

In this context, the term network device refers to any hardware device capable of communicating via and/or as part of a network. Likewise, a computing device refers to any hardware device capable of performing computations, such as arithmetic or logical operations. Network devices may be capable of sending or receiving signals (e.g., signal packets), such as via a wired or wireless network; however, may, in an embodiment, also be capable of performing arithmetic or logic operations, processing or storing signals, such as in memory as physical memory states, and/or may, for example, operate as a client and/or server. Similarly, computing devices may be capable of processing or storing signals, such as in memory as physical memory states, and/or may, for example, operate as a client and/or server. Likewise, a computing device in an embodiment may be capable of sending or receiving signals.

A network may comprise two or more network devices and/or may couple network devices so that signal communications, such as in the form of signal packets, for example, may be exchanged, such as between a server and a client device or other types of network devices, including between wireless devices coupled via a wireless network, for example.

A network may also include now known, or to be later developed arrangements, derivatives, and/or improvements, including, for example, past, present or future mass storage, such as network attached storage (NAS), a storage area network (SAN), or other forms of computer or machine readable media, for example. A network may include the Internet, one or more local area networks (LANs), one or more wide area networks (WANs), wire-line type connections, wireless type connections, other connections, or any combination thereof. Likewise, sub-networks, such as may employ differing architectures or may be compliant or compatible with differing protocols, such as communication protocols (e.g., network communication protocols), may interoperate within a larger network. Various types of network devices may be made available so that device interoperability is enabled and/or, in at least some instances, may be transparent to the devices. In this context, the term transparent refers to network devices communicating via a network in which the devices are able to communicate via intermediate network devices, but without the communicating devices necessarily specifying one or more intermediate devices and/or may include communicating as if intermediate devices are not necessarily involved in communication transmissions.

The Internet refers to a decentralized global network of interoperable networks. The Internet includes local area networks (LANs), wide area networks (WANs), wireless networks, or long haul public networks that, for example, may allow signal packets to be communicated between LANs. Signals, such as packets, also referred to as signal packet transmissions, may be communicated between nodes of a network, where a node may comprise one or more network devices, for example. As an illustrative example, but without limitation, a node may comprise one or more sites employing a local network address. A signal packet may, for example, be communicated via a communication channel or a communication path comprising the Internet, from a site via an access node coupled to the Internet. Likewise, a signal packet may be forwarded via network nodes to a target site coupled to a local network, for example. A signal packet communicated via the Internet, for example, may be routed via a path comprising one or more gateways, servers, etc. that may, for example, route a signal packet in accordance with a target address and availability of a network path to a target address.

In the context of the present application, the term "auditory," such as used in connection with auditory stimuli, for example, refers to being audible, such as audible sound, as an example. Auditory stimulus may result, as an example, at least in part, from pressure waves propagating through an intervening medium, such as, for example, the atmosphere of the Earth, e.g., air. The term "audio" may likewise be used interchangeably with "auditory," unless the particular context of usage suggests otherwise. In contrast, the term "tactile," such as used in connection with tactile stimuli, refers, for example, to stimuli capable of being perceived by way of a human's sense of touch. For example, vibrations are one example illustrating a type of tactile stimuli. Additionally, in this context, the term "multimedia," such as in connection with stimuli, for example, may comprise auditory stimuli, tactile stimuli, visual stimuli, or any combination thereof.

In this context, a device capable of producing auditory output signals (e.g., stimuli) or tactile output signals (e.g., stimuli) is referred to as an emitter, such as an auditory emitter or a tactile emitter, respectively. An emitter may comprise in one embodiment a tunable waveform responsive device. For example, a speaker comprises an example of an auditory emitter. Other than if characterized as output signals (e.g., stimuli), in this context, the term signals, such as if referring to auditory signals or tactile signals, for example, although present in a different physical form, such as an electrical form, for example, are understood to refer to physical phenomena that the signals represent. Thus, for example, an auditory signal may refer to an electrical signal transmitted, such as via an electrical wire or wirelessly, to an emitter, such as a speaker. In this example, the emitter may produce an auditory output signal in response to the received electrical signal.

Thus, in an embodiment, devices described herein, including emitters, for example, may be included in a network configuration, such as, for example, previously described. It is likewise understood that signals, such as auditory or tactile signals, may go through an innumerable number of signal transformations before being received at an emitter to produce stimuli, such as auditory or tactile stimuli. For example, a signal may be transformed from analog to digital or vice-versa. Likewise, a signal may be compressed, encoded, packetized, encrypted, etc. and still remain an auditory signal or tactile signal, for example. The term waveform refers to a particular type of signal, e.g., having a particular form and shape including, for example, signals having the form of a wave.

As suggested previously, if an individual is affected by certain conditions that may impair the individual's ability to hear, an individual may make use of a hearing aid to amplify and/or perform other signal conditioning to improve perception of sound, particularly speech. However, it is, of course, understood that application of claimed subject matter is not intended to be limited in scope to only hearing impaired individuals. Nonetheless, continuing with this example, in designing hearing aids, an emphasis may be placed on enhancing an individual's ability to recognize and/or distinguish sound corresponding to human speech. For example, a peak response of a hearing aid may correspond to frequency ranges prevalent in human speech, such as between 500.0 Hz and 2000.0 Hz, with many hearing aids performing less adequately at frequencies above 2500.0 Hz. Accordingly, for example, if listening to piano music, for example, which may include a range of auditory frequencies from as low as approximately 30.0 Hz to as high as approximately 4.1 kHz, an individual may perceive that some notes (e.g., frequencies) are virtually non-existent. In other instances, certain notes (e.g., frequencies) may be discernible, but at reduced amplitudes. Thus, a hearing aid, for some musical instruments, for example, such as pianos, flutes, clarinets, and so forth, and particularly for situations involving multiple instruments and/or complex music in terms of an array of notes played in a narrow span of time, for example, may produce distorted auditory stimuli for a user of a hearing aid in comparison with the auditory stimuli (e.g., sound) perceived by a person with relatively normal hearing. In such instances, for example, an individual's favorite concerto may sound muffled, garbled, and/or indistinct if heard using a hearing aid or similar hearing assistance device.

In one embodiment, an individual's multimedia experience may be improved through use of tactile emitters in direct or indirect physical contact with an individual's skin, such as, for example, situated in contact with one or more of a user's fingers, wrist, sternum, and/or other locations besides the above-identified. It is noted that the terms user and individual are used interchangeably unless the particular context of usage suggests otherwise.

For example, and without limitation, a source of auditory stimuli, such as a CD player, iPod®, iPhone®, MP3 player, etc., may be capable of producing auditory output signals in response to auditory signals and/or auditory states, such as may be stored, for example. Such a source, as an example, may be coupled to a device capable of generating tactile signals corresponding to the auditory signals, as described in more detail below. In an embodiment, generated tactile signals may augment or complement the auditory signals in a manner so that an individual or user may have an improved auditory experience relative to auditory stimuli taking place without the use of generated tactile signals, for example.

For example, referring to FIG. 1, in an embodiment 10, a device 110 may be coupled to a source, such as player, illustrated, for example, in FIG. 1, as 120. Auditory augmentation device 110 may, for example, comprise a signal amplifier, such as 130. In addition to a signal amplifier, an augmentation device may further comprise a frequency spectrum division device 140 for dividing the frequency spectrum of signals, such as auditory signals, for example.

Signals produced by an augmentation device, such as 110, for example, may be provided to a signal amplifier, which may amplify the signals to a level sufficient to drive, directly or indirectly, one or more tactile emitters, for example. Thus, an augmentation device, such as 110, may produce tactile signals which may also be amplified, such as by amplifier 150. Likewise, tactile signals produced by device 110 may be at least approximately impedance matched for relatively efficiently transfer to tactile emitters placed in direct physical contact with an individual's skin, although, of course, claimed subject matter is not limited in scope in this respect. Thus, an individual may perceive music, for example, through his or her ears as well as through tactile coupling to an individual's skin via one or more tactile emitters, if direct physical contact or indirect physical contact with skin is employed, for example.

In an implementation, a combined effect of auditory stimuli, by way of earphones or speakers, for example, along with tactile stimuli, by way of tactile emitters, may assist an individual's auditory perception. Thus, for example, in an embodiment, complementary tactile stimuli may enhance or augment an individual's auditory experience by providing a multimedia experience. It is noted, of course, that such an approach may also be employed for auditory signals that may accompany video signals, for example.

In an implementation, as an illustrative example, signals within certain ranges of frequencies, at least approximately such as, for example, from approximately 800.0 Hz to approximately 1600.0 Hz, for example, may be provided to one or more tactile emitters at particular locations on an individual, such as to one of the individual's fingers. Tactile stimulation provided in this manner may permit a hearing-impaired individual to enjoy music to a greater extent than without use of tactile stimulation. In an implementation, lower frequencies, such as from approximately 0.0 Hz to approximately 300.0 Hz, may be provided to one or more tactile emitters around a user's sternum or other location at least approximately between an individual's neck and abdomen, for example. Signals having higher frequencies, such as from approximately 1600.0 Hz to approximately 3200.0 Hz, may be provided to different areas, such as a ring fingers, index fingers, toes, wrists, forearms, and so forth. It is, of course, understood that these are merely examples for purposes of illustration and claimed subject matter is not limited in scope to illustrative examples.

Likewise, in an embodiment, adjustment regarding locations for tactile emitters, ranges of frequencies and/or other signal parameters, such as phase or amplitude, for example, may be appropriate to account for individual responses to tactile stimuli. Similarly, over time and/or through use, re-adjustment may likewise be appropriate to, for example, improve an individual's multimedia experience resulting from auditory augmentation, such as may include adjustment as a result of experiential development.

As was mentioned, FIG. 1 is a schematic of an embodiment 10 of a system for multimedia auditory augmentation. In the example of FIG. 1, a source of music, such as 120 may represent, for example, a compact disc player, an iPod or smart phone, such as an iPhone, an MP3 player, microphone, an AM or FM radio, a phonograph, or other source of music, such as stored or recorded music, for example. In a non-limiting example, source 120 may be capable of producing audio signals, such as by receiving or reading audio signals or states, such as via a network or from storage media, such as, for example, by way of compressed lossy formats, such as MP3, Vorbis, Musepack, AAC, ATRAC or Windows Media Audio Lossy (WMA lossy), for example. In other implementations, source 120 may be capable of producing audio signals, such as by receiving or reading audio signals or states, such as via a network or from storage media, such as, for example, by way of lossless compression, such as FLAG, Monkey's Audio (filename extension APE), WavPack (filename extension WV), TTA, ATRAC Advanced Lossless, Apple Lossless (filename extension m4a), MPEG-4 SLS, MPEG-4 ALS, MPEG-4 DST, Windows Media Audio Lossless (WMA Lossless), or Shorten (SHN), for example. In still other implementations, source 102 may be capable of producing audio signals by receiving or reading audio signals or states, such as via a network or from storage media, by way of uncompressed audio formats, such as WAV, AIFF, AU or raw headerless PCM, for example. It should be noted that although some audio formats may provide a richer audio and/or multimedia experience than other formats, claimed subject matter is not limited to use of particular analog, uncompressed digital, lossless compressed digital, or lossy compressed digital formats. Furthermore, as discussed later, richness, fidelity or other properties of a particular format may potentially affect auditory augmentation processing in some embodiments.

As illustrated in FIG. 1, player 120 may convey auditory signals to an input port of signal amplifier 130 and to frequency spectrum division device 140. In an implementation, signal amplifier 130 represents an electronic circuit that may employ low-distortion amplification of input signals. In an implementation, amplifier 130 may employ Class A amplification so that an input signal from player 120 may be amplified without significant harmonic content or other distortion-related artifacts. Amplifier 130 may generate a signal and may have an output impedance of 4.0 ohms, 8.0 ohms, or other output impedance suitable for coupling to an input port of a speaker or similar device for generating auditory output signals. In other implementations, amplifier 130 may have an output impedance of 16.0 ohms, 32.0 ohms, 64.0 ohms, or as high as 600 ohms or higher, which may be suitable for coupling to an input port of headphones or earphones, such as 135 of FIG. 1. However, claimed subject matter is not limited to amplifiers having particular output impedances or to amplifiers suited to particular listening devices and/or related components, such as speakers, headphones, earphones crossover networks, and so forth.

In this illustrative embodiment, frequency spectrum division device 140 may comprise one or more frequency filters for division of signals into components, such as, for example auditory signals, into a set of auditory signal components at least approximately within non-identical separate frequency ranges. For example, auditory components may in combination at least approximately cover a range of frequencies of auditory signals provided. Likewise, auditory components in combination may at least approximately represent auditory signals provided. Of course, this is merely an illustrative embodiment and therefore is not meant to be limiting.

As an example, auditory signals may include signal components in which at least a first signal component is at least approximately within a first range of frequencies and a second signal component is at least approximately within a second range of frequencies. In an implementation, a first frequency range, for example, may comprise from approximately 0.0 to approximately 2500.0 Hz and may be lower than a second frequency range, which may comprise from approximately 2500.0 Hz to approximately 5000.0 Hz. In the example implementation of FIG. 1, however, as shown, division device 140 includes six filter modules for dividing auditory signals into six separate frequency ranges or bands at least approximately. Accordingly, in an embodiment, division device 140 may include an approximately 300.0 Hz low pass filter (LPF) 141, an approximately 300.0 Hz to approximately 800.0 Hz band pass filter (BPF) 142, an approximately 800.0 Hz to approximately 1600.0 Hz band pass filter 143, an approximately 1600.0 Hz to approximately 3200.0 Hz band pass filter 144, an approximately 3200.0 Hz to approximately 5400.0 Hz band pass filter 145, and an approximately 5400.0 Hz high pass filter (HPF) 146. It should be pointed out that although six filters are shown in FIG. 1, any number of filters may be utilized to divide auditory signal into one or more ranges of frequencies. In other implementations, for example, a lesser number of filters may be used, such as two, three, or four. In other implementations, a greater number of filters may be used, such as seven, eight, or more, and claimed subject matter is not limited to implementations in which a particular number of filters comprise division device 140, for example. Further, although certain filter ranges are identified in the implementation of FIG. 1, other implementations may utilize other ranges, and claimed subject matter is intended to embrace all such variations in filter parameters. Likewise, as described below, claimed subject matter is not limited in scope to frequency division of auditory signals to produce tactile signals.

In an implementation, low pass filters, band pass filters, and/or high pass filters may comprise discrete components, such as capacitors and/or inductors comprising certain values of capacitance and/or inductance, respectively, and arranged in certain topologies to achieve filter center frequencies, roll off rates, ripple values, and so forth. Accordingly, filter topologies, such as Butterworth, Chebyshev, elliptical, and so forth, may be utilized. In other implementations, low pass filters, band pass filters, and/or high pass filters may be realized using digital filters techniques, in which signal processing operations may be performed on a sampled discrete-time signal. A computing device, for example, may process sampled auditory signals to produce processed auditory digital signals to be substantially in accord with filter specifications. However, claimed subject matter is not limited to particular filter implementations, such as discrete circuit element topologies or digital filtering techniques, and claimed subject matter is not limited in this respect.

Likewise, as was mentioned, it is understood that auditory signal processing is not limited in scope to frequency filtering as described in the illustrative example of FIG. 1. Rather a variety of types of signal processing may be employed, including filtering substantially in accordance with frequency, phase adjustment, amplitude adjustment, or any combinations thereof. In addition, a host of types of filters may be employed including, merely as examples, feedback filters, feed forward filters, adaptive filters, non-linear filters, or any combinations thereof.

Filtered signals from division device 140 may be conveyed to signal amplifier 150, wherein electrical signals may be converted to signals (e.g., tactile signals) suitable for use with tactile emitters 160, 170, 175, and 180. Signal amplifier 150 may employ a low distortion amplifier so as to boost signal levels without introducing a substantial amount of unwanted harmonics or other artifacts. Signal amplifier 150 may also provide impedance matching so as to more efficiently couple with tactile emitters 160, 170, 175, and/or 180, and/or couple emitters to physical locations on an individual's body. In certain implementations, tactile emitters 160, 170, 175, and/or 180 may comprise a piezoelectric diaphragm, for example. However, tactile emitters are not limited in scope to piezoelectric devices. Any device capable of generation of tactile output signals, including, for example, if applicable, haptic-type devices, may be employed. Other examples may include magneto-resistive materials or devices which may be employed as actuators or transducers, such as made using a Terfenol-D alloy or other materials. Nonetheless, continuing with this example, input impedance of tactile emitters comprising piezoelectric diaphragms, in a non-limiting example, may approximately range from approximately 100 to approximately 150 ohms, although claimed subject matter is intended to embrace tactile emitters using any suitable technology.

Although shown in FIG. 1 as comprising six ports, in other implementations, signal amplifier 150 may comprise any number of ports. In FIG. 1, signal amplifier 150 includes ports coupled to tactile emitter 180, in contact, directly or indirectly, with a user's wrist, as well as tactile emitters 170 and 175 in contact, directly or indirectly, with fingers of a user's left hand. Signal amplifier 150 also includes a port coupled to tactile emitter 160, which is shown in contact, directly or indirectly, with a user's sternum. Although additional ports of tactile signal amplifier 150 are shown as not being coupled to a tactile emitter, in implementations, additional ports of amplifier 150 may be coupled to, for example, tactile emitters in contact with fingers of a user's right hand, a user's right wrist, or other locations. Claimed subject matter is, of course, not limited to signal amplifiers comprising particular numbers of ports.

In an implementation, signal amplifier 150 may generate tactile signals wherein signals, for example, comprise frequencies from particular channels, combinations of channels or all channels of division device 140. It is, of course, understood that tactile signal parameters, such as frequency, phase and/or amplitude, for tactile signals may differ from auditory signal parameters for corresponding auditory signals. In one possible example, a signal port coupled to tactile emitter 180, shown as being in contact with a user's wrist, may comprise a signal having frequencies from approximately 0.0 Hz and extending beyond 5400.0 Hz. Likewise, tactile emitters 170 and 175, shown as being in contact with two fingers of the user's left hand, may comprise a signal having frequencies from approximately 0.0 Hz and extending beyond 5400.0 Hz.

In contrast, however, in some implementations, ports of signal amplifier 150 may provide signals with emphasis on certain frequency components from division device 140 while other frequency components may be deemphasized. Again, as previously discussed, corresponding tactile and auditory signals may differ in signal parameters, such as frequency, however. For example, a user may determine that predominantly lower frequencies, such as, for example, approximately 0.0 to approximately 300.0 Hz, present at tactile emitter 160 and coupled a user's sternum or other location between an individual's neck and abdomen, may provide a pleasant experience if player 120 is producing particular types of auditory and/or multimedia signals. Similarly, a user may find it desirable for signals of predominantly higher frequencies, such as, for example, approximately 3200.0 Hz to approximately 5400.0 Hz, to be used with tactile emitter 175 at a user's ring finger, for example. Claimed subject matter is intended to cover all instances in which one or more frequency components or other signal parameters may be emphasized at a tactile emitter and one or more frequency components or other signal parameters may be deemphasized.

Figure 2:
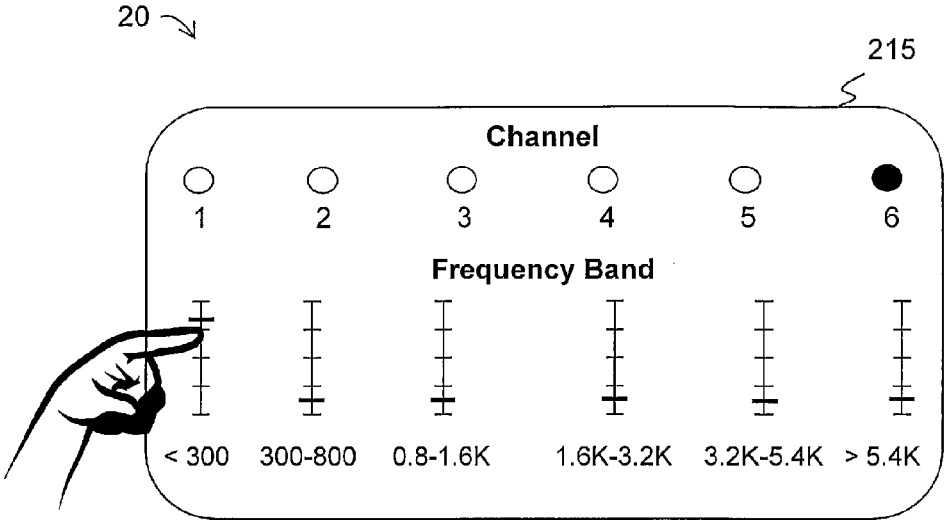
FIG. 2 is a schematic diagram of an embodiment of an interface for use in connection with an embodiment of a system for multimedia auditory augmentation.

FIG. 2 shows an interface, such as a graphical user interface (GUI), 20 for at least in part controlling an augmentation device according to an embodiment. Interface 215 may be implemented as a touch screen or other type of electronic visual display that is capable of detecting presence and/or location of a touch within a display area. In the example of FIG. 2, channel "6" has been selected, as indicated by a darkened radio button. A user's finger may be seen at least in part controlling, such as emphasizing or deemphasizing, relative signal level for a frequency band corresponding to less than 300 Hz with relative signal amplitudes of other frequencies remaining at decreased levels.

An interface, such as of FIG. 2, may be implemented using various platforms, including by way of an application or "app" for use with an iPod®, iPhone®, iPad® or other type of handheld mobile device or smartphone. Likewise, such devices may be in communication via a network for communication of signals providing various forms of stimuli, as previously discussed. In certain implementations, features of interface 215 may be integrated into player 120 of FIG. 1. In other implementations, interface 215 may comprise a standalone unit for performing various operations. Interface 215 may additionally be utilized to affect amplitude levels of frequency bands along with other operations, such as ear or headphone volume, bass, treble, balance, audio track (e.g., song, playlist, etc.) and/or other settings. Of course, in an alternate embodiment, a less manually-oriented, more automated or semi-automated interface may be employed that may not involve direct user access for determining settings. For example, a program to provide appropriate settings, as simply one example, may be employed. Claimed subject matter is intended to embrace a variety of signal level adjustment operations enabled, at least in part, by an interface or GUI, such as 215.

As previously discussed, in an embodiment, tactile signals may be generated to complement auditory signals. A combination of tactile output signals and auditory output signals, such as for example, in the manner previously discussed, may enhance a user's multimedia experience in comparison with auditory output signals alone, such as for a hearing impaired user. Thus, claimed subject matter is, of course, not necessarily limited to use with hearing impaired users. Regardless, in this context, such tactile signals may be referred to as "tactile sound." Likewise, a combination of auditory and tactile signals, such as previously discussed, may be referred to as "sound plus" (or "music plus," for the particular case of music). Resulting auditory signals if combinable with corresponding tactile signals may be referred to as "tactile enhanced."

As discussed previously, generated signals may be stored. Likewise, as part of being written to storage or being read from storage, it is understood, as suggested previously, that signals may traverse a variety of channels or media that may modify the electrical form or format of the signals, although such transformations are not intended to affect the multimedia characterization of such signals, such as being auditory, tactile, visual, etc. This latter consideration, of course, is distinguished from situations in which as signals may be transmitted, such as across a network, for example, in which auditory signals may be combined with tactile signals. Likewise, claimed subject matter is not limited in scope to a particular point in a system or network, for example, at which such combinations may occur as signals processing may take place for use in generating stimuli, for example.

As is well-known a variety of storage media are available, such as flash memory, CDs, DVDs, and a host of others. It is intended that any and all storage media now known or to be developed are contemplated in this context. Thus, for example, storage media may have stored thereon a combination of auditory and tactile signals, e.g., sound plus, or the tactile signals without the corresponding auditory signals, e.g., tactile sound signals. For example, a device may provide auditory output signals using an ordinary CD storing auditory signals while the device also may provide tactile output signals using a CD storing tactile sound signals, as a non-limiting example.

It is likewise noted that a variety of form factors may be available for use as a tactile emitter and it is intended that claimed subject matter not be limited in scope to a particular form factor. For example, a laptop or other portable device, such as a computer, a handheld device, such as a smart phone, or a peripheral device, such as a mouse, as a few examples, may have locations in which fingers may be inserted or fit so that direct physical contact with an individual's skin may be accomplished for experiencing tactile stimuli. Likewise, a glove, a pendant, or even a car steering wheel are other examples in which tactile emitters may be including in a manner so that direct physical contact may take place. It is likewise noted that in addition to stored signals, in an embodiment, a device may for example, receive sound in real-time, such as via a microphone, and produce corresponding tactile signals in real-time for a hearing impaired individual. Likewise, the produced tactile signals may be provided, such as wirelessly transmitted, to one or more local tactile emitters, again as a non-limiting example. These or similar features may be included in a smart phone or tablet, for example.

Figure 3:
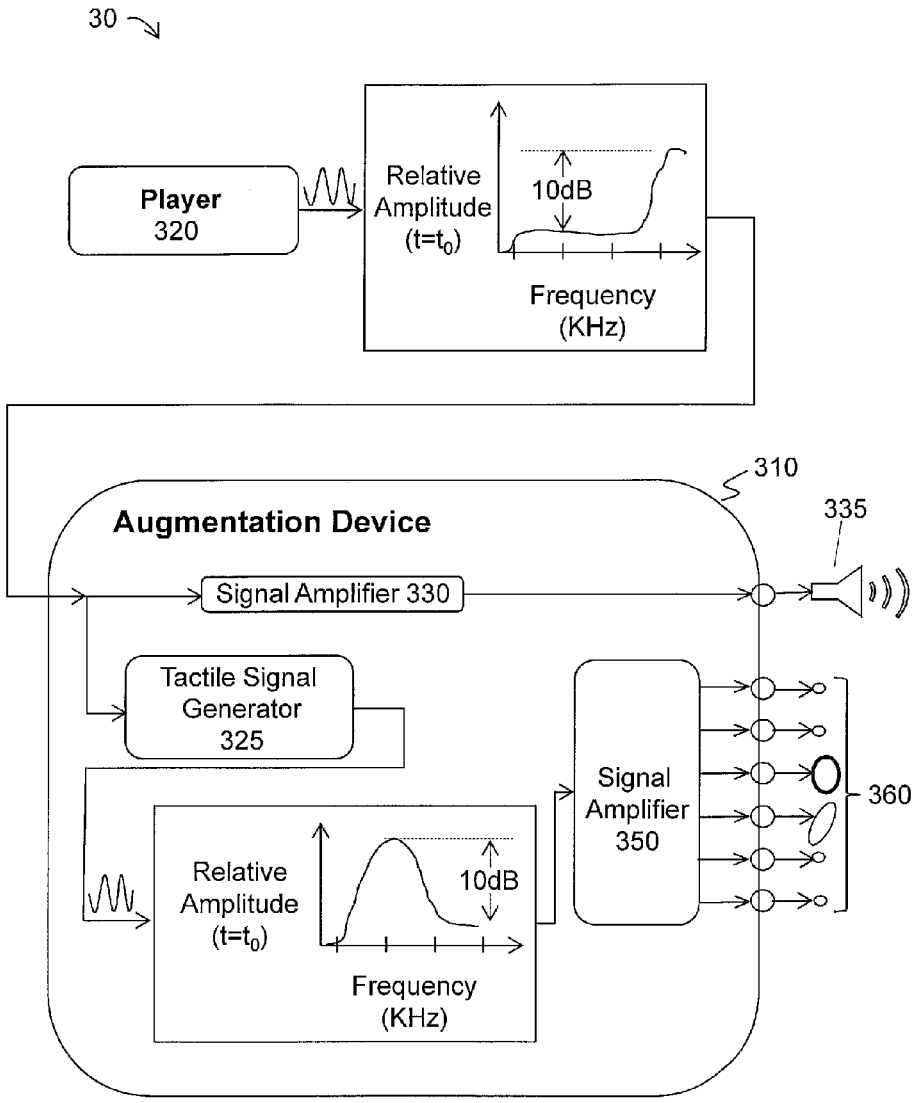
FIG. 3 is a schematic diagram of another embodiment of a system for multimedia auditory augmentation.

FIG. 3 is a schematic of an embodiment system 30. In the example implementation of FIG. 3, player 320 may represent a playback device comprising features similar to that of player 120 of FIG. 1. Further, at least in particular implementations, a user may at least in part exert control over functions performed by player 320, such as by utilizing interface 215 of FIG. 2, for example, including an ability to emphasize and/or deemphasize frequency bands of signals from signal amplifier 350, for example.

In particular implementations, player 320 may generate auditory signals representing music and/or multimedia comprising low levels of certain frequency bands relative to other frequency bands as depicted in signal profile 325. In the example of signal profile 325, amplitude of a lower portion of a signal spectrum at a time $t_0$ ($t=t_0$) may be approximately 10.0 dB lower than an upper portion of a signal frequency spectrum. Signal profile 325 may comprise different profiles at different times, and claimed subject matter is not limited to particular signal spectra. For example, at a time equal to $t_1$ (not shown in FIG. 3) a signal may include larger amplitudes from a lower portion of an output signal frequency spectrum, such as approximately 5.0 dB lower than an upper portion of a signal frequency spectrum. In other examples, at other times, such as $t_2$, $t_3$, $t_4$, and so forth, a signal may include larger amplitudes of lower frequency signals, which may approach or even exceed amplitudes of higher frequency signals. A signal from player 320 may be provided to an input port of augmentation device 310. An input signal may be amplified by way of amplifier 330, and conveyed to speaker 335. It should be noted, however, that speaker 335 may be replaced by ear or headphones, such as 135, for example.

A signal from player 320 may additionally be conveyed to tactile signal generator 325. Tactile signal generator 325 may comprise hardware, such as circuitry for use in signal processing. Likewise, tactile signal generator 325 may comprise a processor programmed to perform signal processing operations. In implementations, tactile signal generator 325 may sense that at a certain time, such as $t=t_0$, relatively small amplitudes of particular frequency bands may be present in a signal from player 320. In response to sensing a low level of signals comprising frequencies from a lower portion of a frequency spectrum, tactile signal generator 325 may generate signals complementing signals from player 320. In the implementation of FIG. 3, for example, tactile signal generator 325 may generate signals from lower portions of a frequency spectrum approximately 10.0 dB higher than signals from an upper portion of a frequency spectrum. At other times, such as $t_1$, $t_2$, $t_3$, and $t_4$, tactile signal generator 325 may generate signals from different portions of a frequency spectrum perhaps comprising amplitudes other than 10 dB (e.g., 5 dB, 8 dB, 12 dB, and so forth). Again, other signal parameters may likewise be adjusted to complement auditory signals, for example. Of course, claimed subject matter is not limited to illustrative examples, such as those previously provided.

Complementary signals may be conveyed from tactile signal generator 325 to signal amplifier 350, which may comprise some or many features similar to that of signal amplifier 150 of FIG. 1. Signals from tactile signal amplifier 350 may be provided to one or more tactile emitters, such as, for example, in direct or indirect physical contact with one or more of a user's fingers, a pendant in direct or indirect physical contact with a user sternum or other location between approximately an individual's neck and abdomen, and/or a bracelet for direct or indirect contact with a user's right or left wrist. It should be noted that in other implementations, tactile emitters may be placed in other locations providing direct or indirect physical contact, and claimed subject matter is not limited in this respect.

Use of tactile signal generator 350 to generate stimulus to complement auditory stimulus generated by player 320 may provide a user with a sensory experience that exceeds an experience provided by auditory stimulus alone. In implementations, the combination of auditory stimulus and tactile stimulus may result in an increase in a user's enjoyment of music and/or multimedia, for example.

In certain implementations, tactile signal generator 325 may comprise a processor, such as a microprocessor or a central processing unit, executing instructions stored on non-transitory storage media, as discussed previously, for example, and in relation to FIG. 5. In particular implementations, tactile signal generator 325 may include logic, implemented in hardware or software, depending upon the particular embodiment, for detecting a reduced signal level for frequencies comprising certain frequency bands, such as signals below 300.0 Hz, signals below 800.0 Hz, and so forth. As a result of detecting reduced signal levels, tactile signal generator 325 may generate signals having frequency characteristics corresponding to, for example, sub-harmonics of frequencies present at higher amplitudes (or having other signal parameters adjusted). In one possible example, if tactile signal generator 325 detects signals present at 2400.0 Hz, over a period of 20.0 ms and detects lower levels of signals proximate with 800.0 Hz, signal generator 325 may generate an 800.0 Hz sub-harmonic tactile signal to complement a 2400.0 Hz tone. Likewise, it is noted that auditory signals above approximately 1 kHz are believed to provide an enriched multimedia experience in combination with corresponding tactile signals, such as if processed in the manner described, for example.

In other implementations, tactile signal generator 325 may generate signals according to a tactile generation program designed to accompany auditory playback. In one possible example, a tactile generation program may be composed to accompany at least portions of Beethoven's ninth Symphony, in which time-varying signals may be generated by tactile signal generator 325 and provided to tactile emitters 360. In particular implementations, this may result in enhancing a user's auditory experience.

In another embodiment, an apparatus may comprise a device to assist with brain development. For example, as a result of hearing loss, portions of an individual's brain may potentially be less developed as a result of hearing impairment. For example, since the auditory cortex may be intact despite loss or reduction of hearing capability, that portion of the brain may be capable of further development despite hearing impairment. Use of tactile signal in combination with auditory signals, for example, may further brain development through use of the nervous system in conjunction with auditory processing. Tactile stimulation in conjunction with auditory stimulation may result in improved brain development in comparison with solely auditory stimulation. For example, the brain may associate different stimuli which may for example assist in further development of the auditory cortex or other portions of the brain despite hearing impairment. It is noted that while auditory stimulation may be perceived via the auditory cortex and tactile stimulation may be perceived via the somatosensory cortex, it is not considered appropriate in this context to assume this necessarily holds true for all situations. Therefore, it is to be understood that claimed subject matter is not intended to be limited in scope to development in only these areas of the brain.

Figure 4:
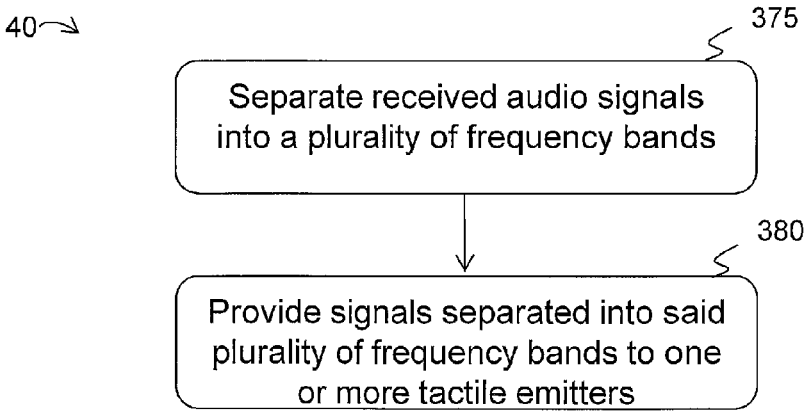
FIG. 4 is a flow diagram for an embodiment of a method for multimedia auditory augmentation.

FIG. 4 is a flow diagram for an embodiment of a method 40. The system of FIG. 1, for example, may be suitable for performing the method of FIG. 4. However, claimed subject matter is not limited to the particular implementation of FIG. 1 and alternate arrangements of components in other implementations may be used. Example implementations, such as those described in FIG. 4 and others herein, may include blocks in addition to those shown and described, fewer blocks, blocks occurring in an order different than may be identified, or any combination thereof.

The method of FIG. 4 begins at block 375 in which audio signals may be separated into a plurality of frequency bands, for example. Audio signals may be separated using, for example, discrete circuits, such as low pass filters, band pass filters, and/or high pass filters utilizing capacitive and/or inductive elements, for example. Alternatively, filters may be implemented digitally, in which signal processing operations may be performed on a sampled discrete-time input signal. At block 380, signals separated into frequency bands may be provided to tactile emitters positioned at various locations on an individual for direct or indirect physical contact with an individual's skin, such as one or more fingers, an individual's wrist, sternum, or other locations.

Figure 5:
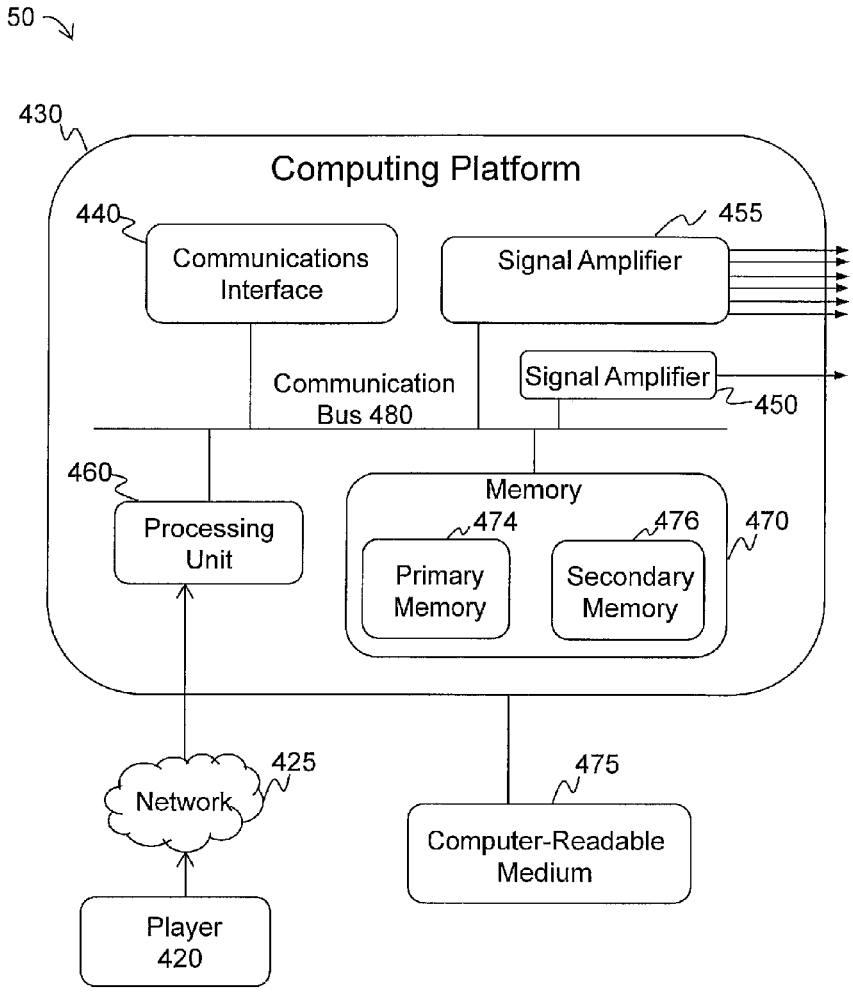
FIG. 5 is an illustration of an embodiment of a computing platform which may be used to implement an embodiment of a method for multimedia auditory augmentation.

FIG. 5 is an illustration of an embodiment of a computing platform 50 that may be employed for example to perform multimedia auditory augmentation. In FIG. 5, computing platform 430 may interface with player 420, which may comprise many features similar to player 120 discussed in relation to FIG. 1. Communications interface 440, signal amplifier 450, signal amplifier 455, processing unit 460, and memory 470, which may comprise primary memory 474 and secondary memory 476, may communicate by way of communication bus 480, for example. In FIG. 5, player 420, which may represent one or more or more sources of analog, uncompressed digital, lossless compressed digital, or lossy compressed digital formats for recording and storing auditory signals, such as for music, as physical memory states, for example. Player 425 may communicate with computing platform 430 by way of an Internet connection via network 425, for example. Although the computing platform of FIG. 5 shows the above-identified elements, claimed subject matter is not limited to computing platforms having only these elements as other implementations may include alternative arrangements that may comprise additional components, fewer components, or components that function differently while achieving similar results. Rather, examples are provided merely as illustrations. It is not intended that claimed subject matter to limited in scope to illustrative examples.

Processing unit 460 may be representative of one or more circuits, such as digital circuits, to perform at least a portion of a computing procedure or process. By way of example but not limitation, processing unit 460 may comprise one or more processors, controllers, microprocessors, microcontrollers, application specific integrated circuits, digital signal processors, programmable logic devices, field programmable gate arrays, and the like, or any combination thereof. In implementations, processing unit 460 may perform signal processing to manipulate sampled signals from player 420 and construct signals to accord with filtering specifications. Filtered signals within various frequency bands (or in accordance with other signal parameters), such as approximately 0.0 Hz to approximately 300.0 Hz, approximately 300.0 Hz to approximately 800.0 Hz, and so forth may be transmitted along communications bus 80 to signal amplifier 455. Likewise, processing unit 460 may transmit audio signals received from player 422 and signal amplifier 450. Signals from signal amplifier 455 may be provided to tactile emitters (not shown in FIG. 5) and audio signals from signal amplifier 450 may be provided to ear or headphones and/or speakers (not shown in FIG. 5).

Memory 470 may be representative of any storage mechanism. Memory 470 may comprise, for example, primary memory 474 and secondary memory 476, additional memory circuits, mechanisms, or combinations thereof may be used. Memory 470 may comprise, for example, random access memory, read only memory, or one or more data storage devices or systems, such as, for example, a disk drive, an optical disc drive, a tape drive, a solid state memory drive, just to name a few examples. Memory 470 may be utilized to store a tactile generation program composed to generate tactile signals to accompany at least portions of auditory signals, such as for a musical score, a symphony, and a playlist of favorite songs, just to name a few examples. Memory 470 may also comprise a memory controller for accessing computer readable-medium 475 that may carry and/or make accessible content, code, and/or instructions, for example, executable by processing unit 460 or some other controller or processor capable of executing instructions, for example.

Under the direction of processing unit 460, memory, such as cells storing physical states, representing for example, a tactile generation program, may be executed by processing unit 460 and generated signals may be transmitted to signal amplifier 455. Processing unit 460 may also receive digitally-encoded signals from player 420 for amplification by signal amplifier 450. Amplifier 450 and amplifier 455 may in combination assist in providing auditory and tactile stimulus to a user through use of emitters (not shown), thereby enhancing a user's enjoyment of music and/or multimedia.

Network 425 may comprise one or more communication links, processes, and/or resources to support exchanging communication signals between a player 420 and computing platform 430. By way of example, but not limitation, network 425 may comprise wireless and/or wired communication links, telephone or telecommunications systems, Wi-Fi networks, Wi-MAX networks, the Internet, the web, a local area network (LAN), a wide area network (WAN), or any combination thereof.

The term "computing platform," as used herein, refers to a system and/or a device, such as a computing device, that includes a capability to process and/or store data in the form of signals and/or states. Thus, a computing platform, in this context, may comprise hardware, software, firmware, or any combination thereof (other than software per se). Computing platform 430, as depicted in FIG. 5, is merely one such example, and the scope of claimed subject matter is not limited to this particular example. For one or more embodiments, a computing platform may comprise any of a wide range of digital electronic devices, including, but not limited to, personal desktop or notebook computers, high-definition televisions, digital versatile disc (DVD) players and/or recorders, game consoles, satellite television receivers, cellular telephones, personal digital assistants, mobile audio and/or video playback and/or recording devices, or any combination of the above. Further, unless specifically stated otherwise, a process as described herein, with reference to flow diagrams and/or otherwise, may also be executed and/or affected, in whole or in part, by a computing platform.

Memory 470 may store cookies relating to one or more users and may also comprise a computer-readable medium that may carry and/or make accessible content, code and/or instructions, for example, executable by processing unit 460 or some other controller or processor capable of executing instructions, for example. A user may make use of an input device, such as a computer mouse, stylus, track ball, keyboard, or any other device capable of receiving an input from a user.

A wireless network may couple client devices, such as player 420 as an example, with a network. A wireless network may employ stand-alone ad-hoc networks, mesh networks, Wireless LAN (WLAN) networks, cellular networks, or the like. A wireless network may further include a system of terminals, gateways, routers, or the like coupled by wireless radio links, or the like, which may move freely, randomly or organize themselves arbitrarily, such that network topology may change, at times even rapidly. Wireless network may further employ a plurality of network access technologies, including Long Term Evolution (LTE), WLAN, Wireless Router (WR) mesh, or 2nd, 3rd, or 4th generation (2G, 3G, or 4G) cellular technology, or other technologies, or the like. Network access technologies may enable wide area coverage for devices, such as client devices with varying degrees of mobility, for example.

A network may enable radio frequency or wireless type communications via a network access technology, such as Global System for Mobile communication (GSM), Universal Mobile Telecommunications System (UMTS), General Packet Radio Services (GPRS), Enhanced Data GSM Environment (EDGE), 3GPP Long Term Evolution (LTE), LTE Advanced, Wideband Code Division Multiple Access (WCDMA), Bluetooth, 802.11b/g/n, or other, or the like. A wireless network may include virtually any type of now known, or to be developed, wireless communication mechanism by which signals may be communicated between devices, such as a client device or a computing device, between or within a network, or the like.

Communications between a computing device and a wireless network may be in accordance with known, or to be developed cellular telephone communication network protocols including, for example, global system for mobile communications (GSM), enhanced data rate for GSM evolution (EDGE), and worldwide interoperability for microwave access (WiMAX). A computing device may also have a subscriber identity module (SIM) card, which, for example, may comprise a detachable smart card that stores subscription information of a user, and may also store a contact list of the user. A user may own the computing device or may otherwise be its primary user, for example. A computing device may be assigned an address by a wireless or wired telephony network operator, or an Internet Service Provider (ISP). For example, an address may comprise a domestic or international telephone number, an Internet Protocol (IP) address, or other identifiers. In other embodiments, a communication network may be embodied as a wired network, wireless network, or combination thereof.

A network or a computing device may vary in terms of capabilities or features. Claimed subject matter is intended to cover a wide range of potential variations. For example, a network or a computing device may include a numeric keypad or a display of limited functionality, such as a monochrome liquid crystal display (LCD) for displaying text. In contrast, however, as another example, a web-enabled computing device may include a physical or a virtual keyboard, mass storage, one or more accelerometers, one or more gyroscopes, global positioning system (GPS) or other location-identifying type capability, or a display with a higher degree of functionality, such as a touch-sensitive color 2D or 3D display, for example.

A computing device may include or may execute a variety now known, or to be developed operating systems, or derivatives and/or versions, including personal computer operating systems, such as a Windows, iOS or Linux, or a mobile operating system, such as iOS, Android, or Windows Mobile, or the like. A computing device may include or may execute a variety of possible applications, such as a client software application enabling communication with other devices, such as communicating one or more messages, such as via email, short message service (SMS), or multimedia message service (MMS), including via a network, such as a social network including, but not limited to, Facebook, LinkedIn, Twitter, Flickr, or Google+, to provide only a few examples. A computing device may also include or execute a software application to communicate content, such as, for example, textual content, multimedia content, or the like. A computing device may also include or execute a software application to perform a variety of possible tasks, such as browsing, searching, playing various forms of content, including locally stored or streamed video, or games such as, but not limited to, fantasy sports leagues. The foregoing is provided merely to illustrate that claimed subject matter is intended to include a wide range of possible features or capabilities.

It will, of course, be understood that, although particular embodiments will be described, claimed subject matter is not limited in scope to a particular embodiment or implementation. For example, one embodiment may be in hardware, such as implemented to operate on a device or combination of devices, for example, whereas another embodiment may be in software. Likewise, an embodiment may be implemented in firmware, or as any combination of hardware, software, and/or firmware, for example (other than software per se). Likewise, although claimed subject matter is not limited in scope in this respect, one embodiment may comprise one or more articles, such as a storage medium or storage media. Storage media, such as, one or more CD-ROMs and/or disks, for example, may have stored thereon instructions, executable by a system, such as a computer system, computing platform, or other system, for example, that may result in an embodiment of a method in accordance with claimed subject matter being executed, such as a previously described embodiment, for example; although, of course, claimed subject matter is not limited to previously described embodiments. As one potential example, a computing platform may include one or more processing units or processors, one or more devices capable of inputting/outputting, such as a display, a keyboard and/or a mouse, and/or one or more memories, such as static random access memory, dynamic random access memory, flash memory, and/or a hard drive.

Likewise, in this context, the terms "contact," "coupled" or "connected," or similar terms, may be used. It should be understood that these terms are not intended as synonyms. Rather, "connected" may be used to indicate that two or more elements or other components, for example, are in direct physical or electrical contact; while, "contact" or "coupled" may mean that two or more elements are in direct physical or electrical contact; however, "contact" or "coupled" may also mean that two or more elements are not in direct contact, but may nonetheless co-operate or interact. The term coupled or contact may also be understood to mean indirectly connected or in indirect contact, for example, in an appropriate context.

The terms, "and", "or", and "and/or" as used herein may include a variety of meanings that also are expected to depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein may be used to describe any feature, structure, and/or characteristic in the singular and/or may be used to describe a plurality or some other combination of features, structures and/or characteristics. Though, it should be noted that this is merely an illustrative example and claimed subject matter is not limited to this example.

In the preceding detailed description, numerous specific details have been set forth to provide a thorough understanding of claimed subject matter. However, it will be understood by those skilled in the art that claimed subject matter may be practiced without these specific details. In other instances, methods and/or apparatuses that would be known by one of ordinary skill have not been described in detail so as not to obscure claimed subject matter. Some portions of the preceding detailed description have been presented in terms of logic, algorithms and/or symbolic representations of operations on binary signals or states, such as stored within a memory of a specific apparatus or special purpose computing device or platform. In the context of this particular specification, the term specific apparatus or the like includes a general purpose computing device, such as general purpose computer, once it is programmed to perform particular functions pursuant to instructions from program software.

Algorithmic descriptions and/or symbolic representations are examples of techniques used by those of ordinary skill in the signal processing and/or related arts to convey the substance of their work to others skilled in the art. An algorithm is here, and generally, is considered to be a self-consistent sequence of operations and/or similar signal processing leading to a desired result. In this context, operations and/or processing involve physical manipulation of physical quantities. Typically, although not necessarily, such quantities may take the form of electrical and/or magnetic signals and/or states capable of being stored, transferred, combined, compared, processed or otherwise manipulated as electronic signals and/or states representing information. It has proven convenient at times, principally for reasons of common usage, to refer to such signals and/or states as bits, data, values, elements, symbols, characters, terms, numbers, numerals, information, and/or the like. It should be understood, however, that all of these or similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining", "establishing", "obtaining", "identifying", "selecting", "generating", and/or the like may refer to actions and/or processes of a specific apparatus, such as a special purpose computer and/or a similar special purpose computing device. In the context of this specification, therefore, a special purpose computer and/or a similar special purpose computing device is capable of processing, manipulating and/or transforming signals and/or states, typically represented as physical electronic and/or magnetic quantities within memories, registers, and/or other information storage devices, transmission devices, and/or display devices of the special purpose computer and/or similar special purpose computing device. In the context of this particular patent application, as mentioned, the term "specific apparatus" may include a general purpose computing device, such as a general purpose computer, once it is programmed to perform particular functions pursuant to instructions from program software.

While there has been illustrated and/or described what are presently considered to be example features, it will be understood by those skilled in the relevant art that various other modifications may be made and/or equivalents may be substituted, without departing from claimed subject matter. Additionally, many modifications may be made to adapt a particular situation to the teachings of claimed subject matter without departing from the central concept(s) described herein. Therefore, it is intended that claimed subject matter not be limited to the particular examples disclosed, but that such claimed subject matter may also include all aspects falling within appended claims and/or equivalents thereof.

We claim:

1. An apparatus comprising: a computing device to generate signals for driving directly or indirectly multiple tactile stimuli emitters to be complementary to signals driving directly or indirectly corresponding auditory stimuli, the multiple emitters to be in physical contact with an individual's skin to improve auditory perception by the individual, wherein the signals to be generated are to be in different frequency ranges, the frequency ranges to correspond to frequency ranges for auditory stimuli, and wherein the one or more of the frequency ranges of the signals to be generated to be changed based at least in part on individual response to tactile stimuli provided in combination with auditory stimuli.

2. The apparatus of claim 1, wherein the different frequency ranges in combination to at least approximately cover an audible range of sound.

3. The apparatus of claim 2, wherein the sound comprises music.

4. The apparatus of claim 1, wherein signals to drive corresponding auditory stimuli comprise a source of music, the computing device further capable of generating signals adjusted at least partially to account for fidelity of the source of music.

5. The apparatus of claim 1, wherein the computing device comprises at least one of: a DSP, a microcontroller, a microprocessor, an integrated circuit, or any combination thereof.

6. The apparatus of claim 1, wherein the signals to be generated are the same or substantially similar to the signals to drive directly or indirectly the auditory stimuli.

7. The apparatus of claim 1, wherein the computing device is further capable of storing the signals to be generated.

8. The apparatus of claim 7, wherein the computing device comprises a mobile handheld device.

9. The apparatus of claim 8, wherein the mobile handheld device includes an interface for implementing signal level adjustment operations.

10. The apparatus of claim 9, wherein the interface is capable of implementing signal level adjustment operations at least semi-automatically.

11. The apparatus of claim 8, wherein the computing device is capable of operating as or with a hearing augmentation device.

12. The apparatus of claim 8, wherein the mobile handheld device comprises a smart phone.

13. The apparatus of claim 1, wherein the multiple emitters to be in direct physical contact with an individual's skin.

14. The apparatus of claim 1, wherein one or more of the amplitudes of the signals to be generated is to be changed based at least in part on individual response to tactile stimuli provided in combination with auditory stimuli.

15. The apparatus of claim 1, wherein the signals to be generated are different from the signals to drive directly or indirectly the auditory stimuli.

16. The apparatus of claim 1, wherein the emitters are part of a form factor capable of direct physical contact with an individual's skin.

17. The apparatus of claim 16, wherein the form factor comprises a glove, pendant or steering wheel.

18. The apparatus of claim 1, wherein the computing device is incorporated in a digital electronic multimedia device.

19. The apparatus of claim 18, wherein the digital electronic multimedia device comprises: a personal desktop, a notebook computers, a high-definition televisions, a digital versatile disc (DVD) player and/or recorder, a game console, a mobile audio and/or video playback and/or recording device, or any combination of the above.

20. The apparatus of claim 18, wherein the digital electronic device comprises a repository of stored previously generated signals for later playback.

21. A method comprising: generating signals for driving directly or indirectly multiple tactile stimuli emitters to be complementary to corresponding signal generated auditory stimuli, the multiple emitters to be in physical contact with an individual's skin to improve auditory perception by the individual, wherein the generated signals in different frequency ranges, the frequency ranges correspond to frequency ranges for the auditory stimuli, and further comprising: changing one or more of the frequency ranges of the generated signals based at least in part on individual response to tactile stimuli provided in combination with auditory stimuli.

22. The method of claim 21, wherein the different frequency ranges in combination at least approximately cover an audible range of sound.

23. The method of claim 21, wherein the signals to be generated are the same or substantially similar to the signals to drive directly or indirectly the auditory stimuli.

24. The method of claim 23, and further comprising: storing the generated signals.

25. The method of claim 21, wherein the multiple emitters to be in direct physical contact with an individual's skin.

26. The method of claim 21, wherein the signal generated auditory stimuli comprises music.

27. The method of claim 26, wherein the generating signals comprises generating signals adjusted at least partially to account for fidelity of the signal generated music.

28. The method of claim 21, and further comprising: changing the location of physical contact of one or more of the multiple tactile stimuli emitters based at least in part on individual response to tactile stimuli provided in combination with auditory stimuli.

29. The method of claim 21, and further comprising: changing one or more of the amplitudes of the generated signals based at least in part on individual response to tactile stimuli provided in combination with auditory stimuli.

30. The apparatus of claim 1, wherein the location of physical contact of one or more of the multiple tactile stimuli emitters is to be changed based at least in part on individual response to tactile stimuli provided in combination with auditory stimuli.

31. The method of claim 21, wherein the signals to be generated are different from the signals to drive directly or indirectly the auditory stimuli.

32. The method of claim 21, wherein the signals generated are transmitted wirelessly to the emitters.

* * * * *